US007121501B1

(12) United States Patent
Lea

(10) Patent No.: US 7,121,501 B1
(45) Date of Patent: Oct. 17, 2006

(54) WIRE SPOOLING SYSTEM

(76) Inventor: Frederick L. Lea, 9445 Old Needville Fairchilds Rd., Needville, TX (US) 77461

( * ) Notice: Subject to any disclaimer, the term of this patent is extended or adjusted under 35 U.S.C. 154(b) by 210 days.

(21) Appl. No.: 10/985,223

(22) Filed: Nov. 9, 2004

(51) Int. Cl.
*B65H 75/14* (2006.01)
*B65H 75/18* (2006.01)

(52) U.S. Cl. ..... 242/608.2; 242/608.5; 242/608.6; 242/609.1; 242/609.3; 242/608.3

(58) Field of Classification Search ..... 424/607, 424/608, 608.1–608.3, 608.5–608.6, 609, 424/609.1, 609.3, 601, 118.4, 118.6, 118.61
See application file for complete search history.

(56) References Cited

U.S. PATENT DOCUMENTS

| | | | | |
|---|---|---|---|---|
| 3,830,445 | A | 8/1974 | Moore | 242/118.4 |
| 3,836,093 | A | 9/1974 | Mozina et al. | 242/118.6 |
| 3,837,597 | A | 9/1974 | Bourhenne | 242/129 |
| 4,151,963 | A * | 5/1979 | Ruiz-Barbotteau | 242/608.1 |
| 4,667,897 | A | 5/1987 | Burrow et al. | 242/129 |
| 4,765,560 | A | 8/1988 | Branback | 242/129 |
| 4,844,376 | A | 7/1989 | Maraman, Sr. | 242/129 |
| 4,973,011 | A | 11/1990 | Wilson | 242/129 |
| 5,222,683 | A | 6/1993 | Blackshire | 242/137.1 |
| RE34,376 | E | 9/1993 | Branback | 242/129 |
| 5,267,705 | A | 12/1993 | Hofrichter et al. | 242/129 |
| 5,348,241 | A | 9/1994 | Huette | 242/597.5 |
| 5,551,647 | A | 9/1996 | Browning | 242/578.2 |
| 5,810,283 | A | 9/1998 | Shea | 242/559.1 |
| 6,102,327 | A * | 8/2000 | Ripplinger | 242/609.1 |
| 6,289,570 | B1 * | 9/2001 | Peterson et al. | 29/458 |
| 2002/0023984 | A1 * | 2/2002 | Oppmann et al. | 242/580 |

* cited by examiner

*Primary Examiner*—William A. Rivera
*Assistant Examiner*—Sang Kim
(74) *Attorney, Agent, or Firm*—Michael S. Neustel

(57) ABSTRACT

A wire spooling system for spooling and dispensing wire. The wire spooling system includes a first spool member, having a tubular member with a locking cap and first collar, and a second spool member, having an engagement aperture and second collar. The tubular member extends through the first spool member substantially transverse to the first spool member. The locking cap is positioned at the end of the tubular member opposite the first spool member. The first collar protrudes from the first spool member in the same plane and direction as the tubular member. The second collar protrudes from the second spool member and fits within the first collar. The spool members thereby form a spool shape. Upon fitting the second collar within the first collar, the engagement aperture receives the locking cap of the tubular member, securing the first spool member and second spool member in a locked position.

20 Claims, 8 Drawing Sheets

WIRE SPOOLING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to wire dispensing spool devices and more specifically it relates to a wire spooling system for efficiently spooling and dispensing previously unspooled wire.

2. Description of the Related Art

Wire dispensing spool devices have been in use for years. Typically, wire spools were only sold in large sizes with gigantic amounts of wire wound around the spool. These types of spools of wire were only usable with large equipment and were difficult to effectively manage and transport.

More recently, wire spools came in smaller portions that were more manageable for smaller companies' needs for spooled wire. The smaller spools and lessened amounts of wire have proved a great help to smaller contractors and electricians. However, a main existing problem was that there were certain types of wire that still only came on a spool in gigantic quantities. These types of wire were still difficult to manage and required heavy machinery move around.

Additionally, unspooled wire that was sold in smaller quantities required a user to unravel the wire from the inside out. This caused twisting of the wire thereby reducing its quality.

In these respects, the wire spooling system according to the present invention substantially departs from the conventional concepts and designs of the prior art, and in so doing provides an apparatus primarily developed for the purpose of efficiently spooling and dispensing previously unspooled wire.

BRIEF SUMMARY OF THE INVENTION

In view of the foregoing disadvantages inherent in the known types of wire dispensing spool devices now present in the prior art, the present invention provides a new wire spooling system construction wherein the same can be utilized for efficiently spooling and dispensing previously unspooled wire.

The general purpose of the present invention, which will be described subsequently in greater detail, is to provide a new wire spooling system that has many of the advantages of the wire dispensing spool devices mentioned heretofore and many novel features that result in a new wire spooling system which is not anticipated, rendered obvious, suggested, or even implied by any of the prior art wire dispensing spool devices, either alone or in any combination thereof.

To attain this, the present invention generally comprises a first spool member, having a tubular member with a locking cap and a first collar, and a second spool member, having an engagement aperture and a second collar. The tubular member extends from the first spool member in direction substantially transverse to the first spool member. The locking cap is positioned at the end of the tubular member opposite the first spool member. The first collar protrudes from the first spool member in the same plane and direction as the tubular member. The second collar protrudes from the second spool member and fits within the first collar, wherein the first and second spool members thereby form a spool shape. Upon fitting the second collar inside the first collar, the engagement aperture receives the locking cap of the tubular member, thereby securing the first spool member and the second spool member in a locked position.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a wire spooling system that will overcome the shortcomings of the prior art devices.

A second object is to provide a wire spooling system for efficiently spooling and dispensing previously unspooled wire.

Another object is to provide a wire spooling system that prevents twisting wire when trying to unravel it.

An additional object is to provide a wire spooling system that simplifies work with unspooled wire traditionally used in home improvement projects.

A further object is to provide a wire spooling system that is easily assembled.

Another object is to provide a wire spooling system that provides a "split spool" that can be easily transported from one job to another.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
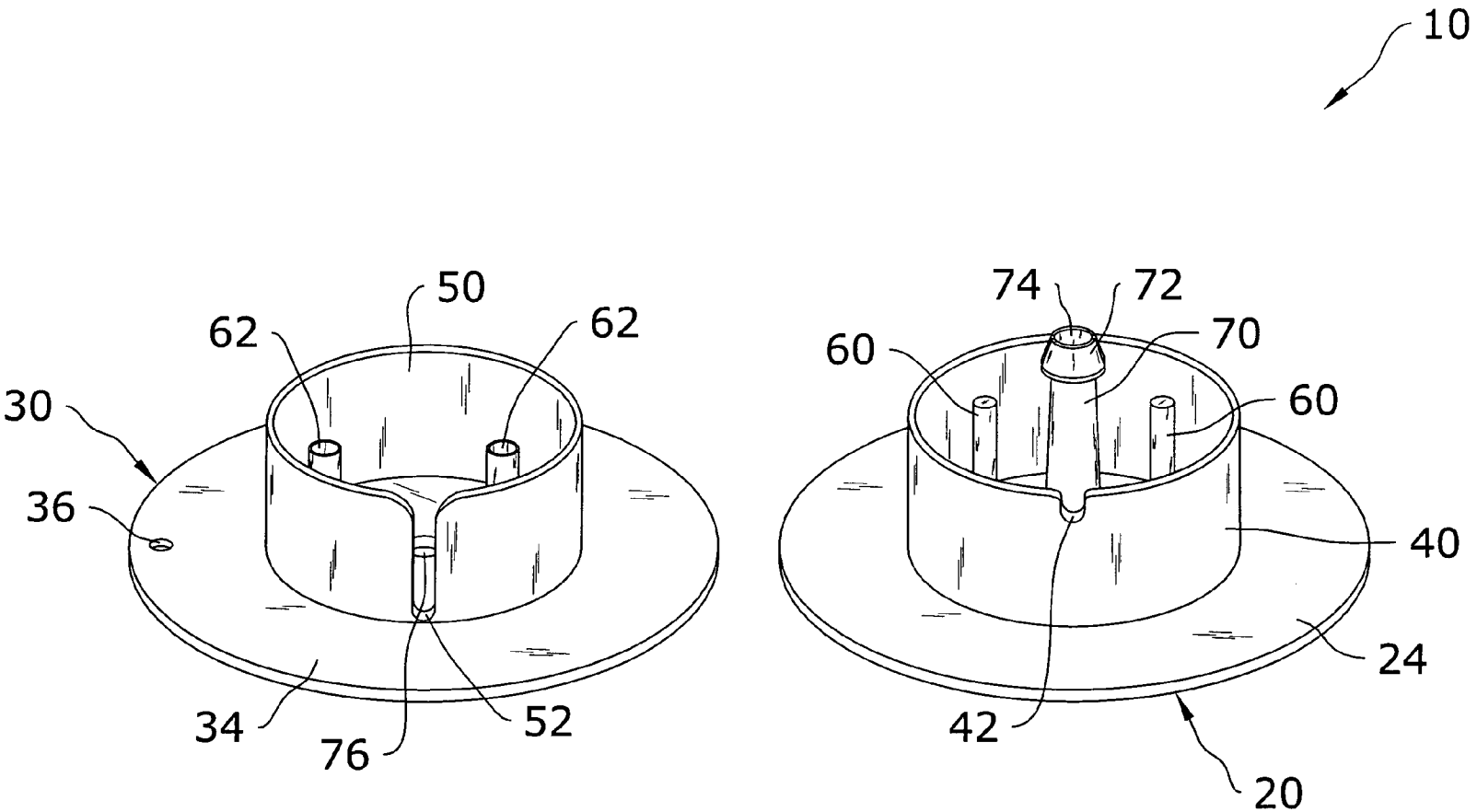
FIG. 1 is an exploded upper perspective view illustrating the components located on the facing sides of each wire spooling system component.

Turning now descriptively to the drawings, in which similar reference characters denote similar elements throughout the several views, FIGS. 1 through 8 illustrate a wire spooling system 10, which comprises a first spool member 20, having a tubular member 70 with a locking cap 72 and a first collar 40, and a second spool member 30, having an engagement aperture 76 and a second collar 50. The tubular member 70 extends through the first spool member 20 in direction substantially transverse to the first spool member 20. The locking cap 72 is positioned at the end of the tubular member 70 opposite the first spool member 20. The first collar 40 protrudes from the first spool member 20 in the same plane and direction as the tubular member 70. The second collar 50 of the second spool member 30 fits snugly within the first collar 40, wherein the first spool member 20 and second spool member 30 thereby form a spool shape. Upon fitting the first collar 40 and second collar 50 together, the engagement aperture 76 receives the locking cap 72 of the tubular member 70, thereby securing the first spool member 20 and the second spool member 30 in a locked position.

B. First Spool Member

Figure 2:
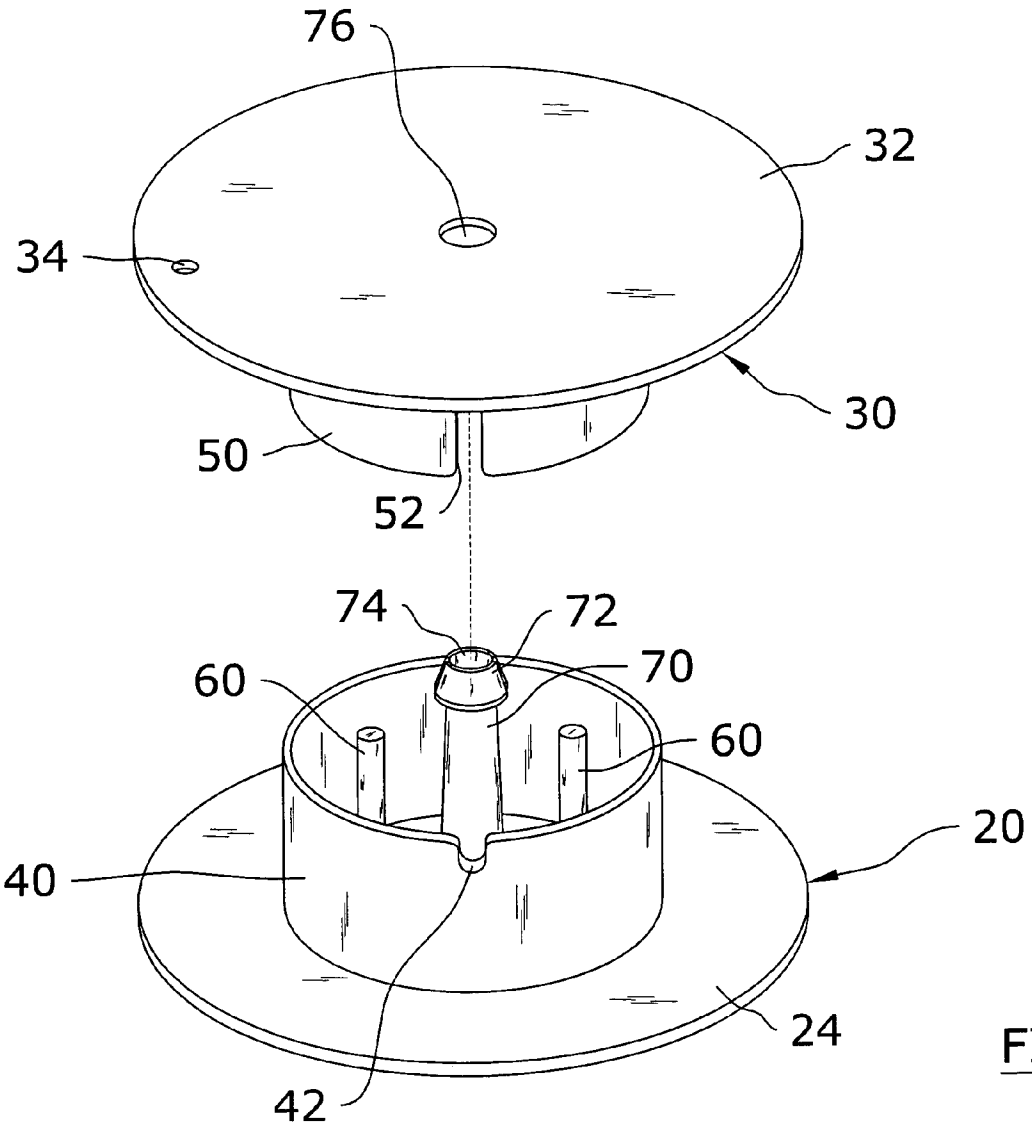
FIG. 2 is an exploded upper perspective view illustrating the positioning of the wire spooling system components prior to assembling the wire spooling system.
Figure 3:
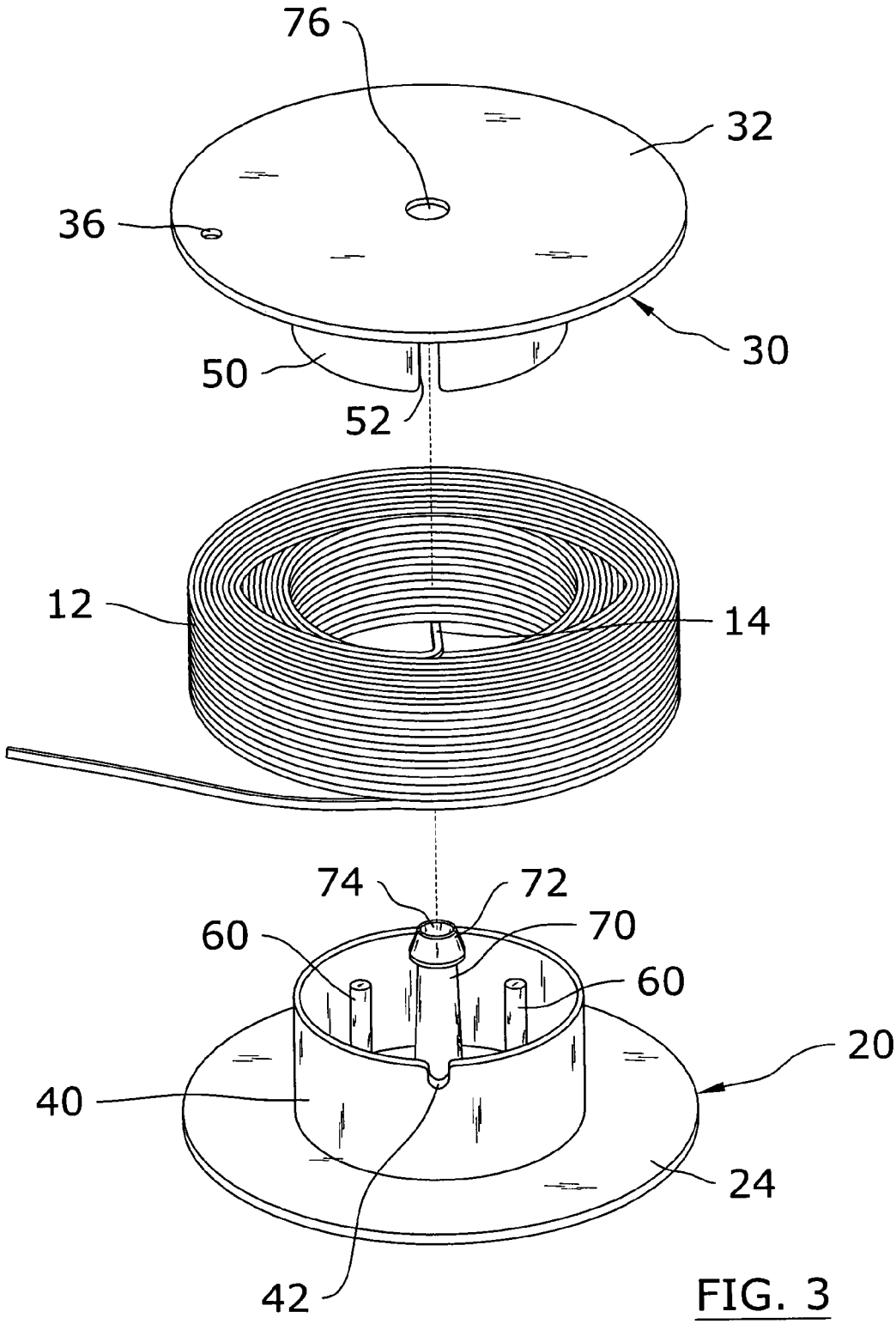
FIG. 3 is an exploded upper perspective view illustrating the positioning of the previously unspooled wire with respect to each wire spooling system component.
Figure 4:
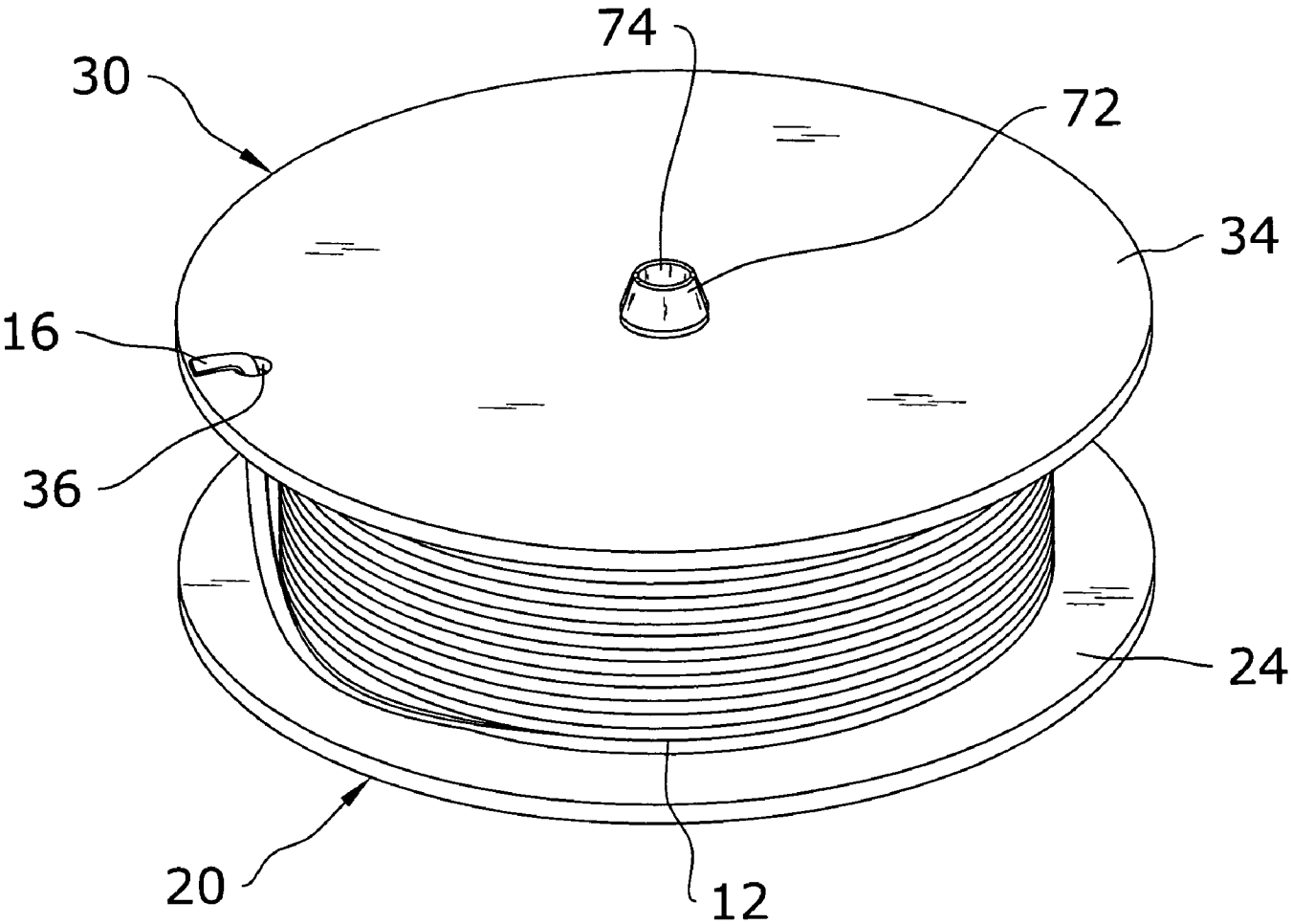
FIG. 4 is an upper perspective view of the present invention in a fully assembled state.
Figure 7:
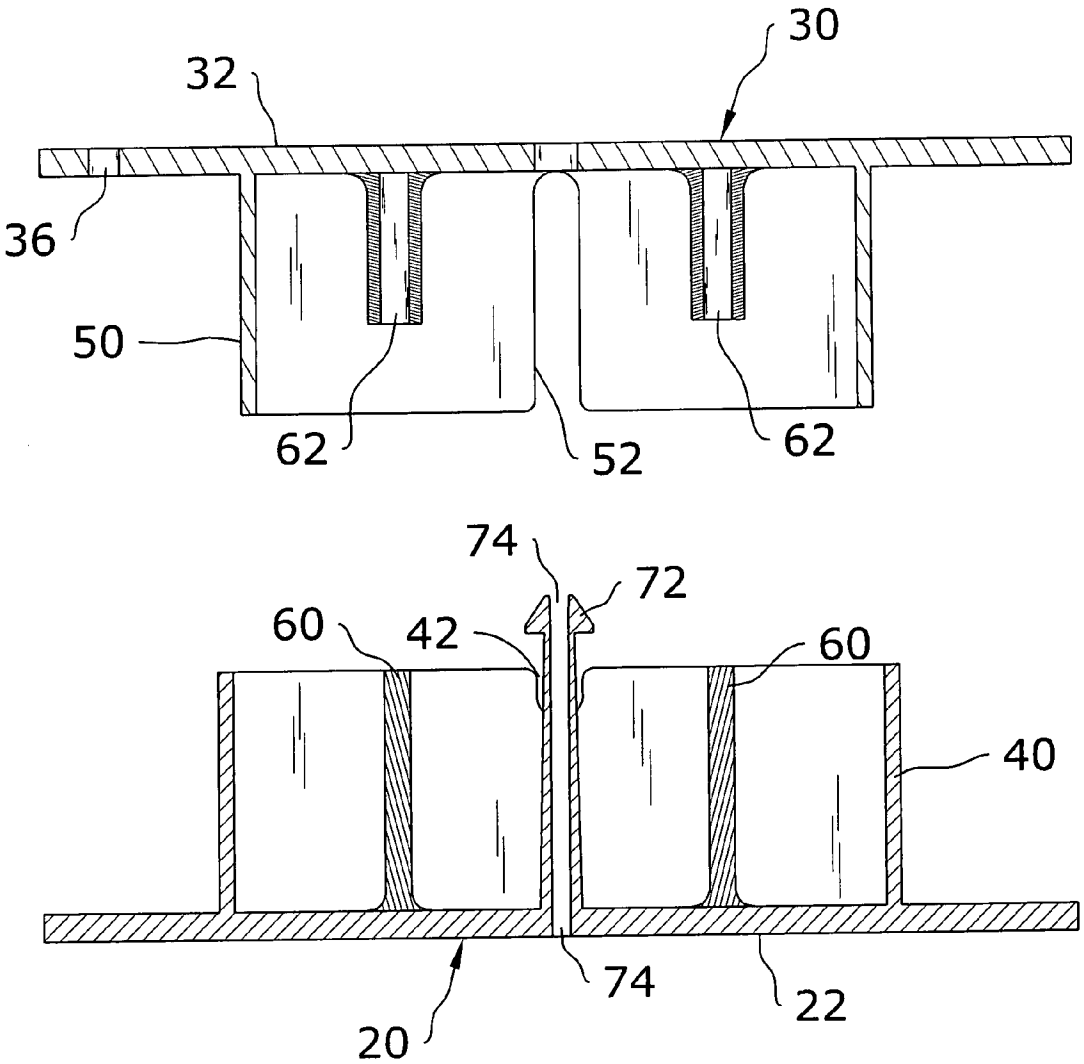
FIG. 7 is an exploded front cutaway view of the present invention illustrating the alignment of the internal components of the wire spooling system prior to assembly.
Figure 8:
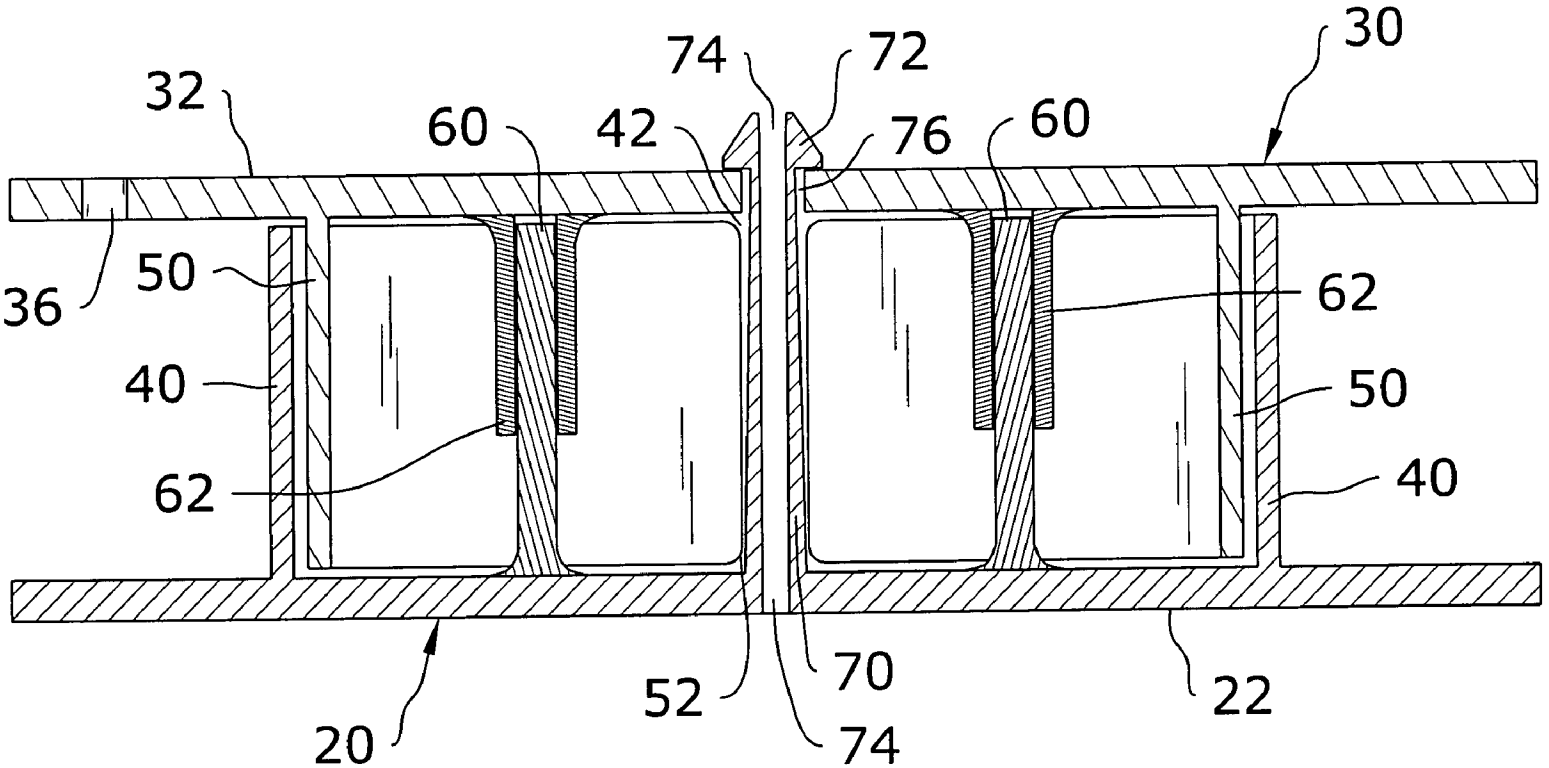
FIG. 8 is a front cutaway view of the present invention in an assembled state.

The first spool member 20 has a first side 22 and a second side 24 that are preferably substantially circular as shown in FIGS. 1 through 4. The first spool member 20 is preferably disc shaped. As shown in FIGS. 4 though 8, the first side 22 is substantially flat. The first side 22 also has an aperture that provides access to a hollow channel 74 that extends through the center of the wire spooling system 10 and out of the locking cap 72 opposite the first side 22 of the first spool member 20 as shown in FIGS. 7 and 8.

The second side 24 is substantially flat and has a first collar 40, a plurality of guide members 60, and a tubular member 70 attached thereto as shown in FIGS. 1 through 3, 7 and 8. The plurality of guide members 60, first collar 40 and tubular member 70 all protrude substantially transverse to the second side 24 of the first spool member 20 as shown in FIGS. 1 through 3, 7 and 8. The guide members 60 and tubular member 70 are preferably located within the perimeter of the first collar 40 as shown in FIGS. 1 through 3.

C. Second Spool Member

The second spool member 30 has a first side 32 and a second side 34 that are preferably substantially circular as shown in FIGS. 1 through 4. The second spool member 30 is preferably disc shaped. As shown in FIGS. 4 through 8, the first side 32 is substantially flat. The first side 32 also has an engagement aperture 76 to receive the locking cap 72 when securing the first spool member 20 to the second spool member 30 as shown in FIGS. 1, 2, 3 and 8.

The second spool member 30 has a second collar 50 protruding substantially transverse to the second side 34 as shown in FIGS. 1 through 3, 5, 7 and 8. The second side 34 of the second spool member 30 has guide sleeves 62 that protrude from the same side and in the same plane as the second collar 50 and are preferably found within the perimeter of the second collar 50 as shown in FIGS. 1, 7 and 8. The second spool member 30 also has a wire-retaining aperture 36 through the second spool member 30 and positioned outside of the perimeter of the second collar 50 as shown in FIGS. 1 through 4, 7 and 8.

D. Tubular Member

The tubular member 70 is positioned on the second side 24 of the first spool member 20 as shown in FIGS. 1 through 3, 7 and 8. The tubular member 70 has a hollow channel 74 that extends through the middle of the tubular member 70 and spans the entire length of the tubular member 70, thereby spanning the entire width of the assembled wire spooling system 10 as shown in FIG. 8. The tubular member 70 also has a locking cap 72 positioned upon the end of the tubular member 70 opposite the first spool member 20. The tubular member 70 is the connection that links the first spool member 20 to the second spool member 30 when the wire spool system 10 is fully assembled as shown in FIG. 8.

E. Locking Cap

Figure 5:
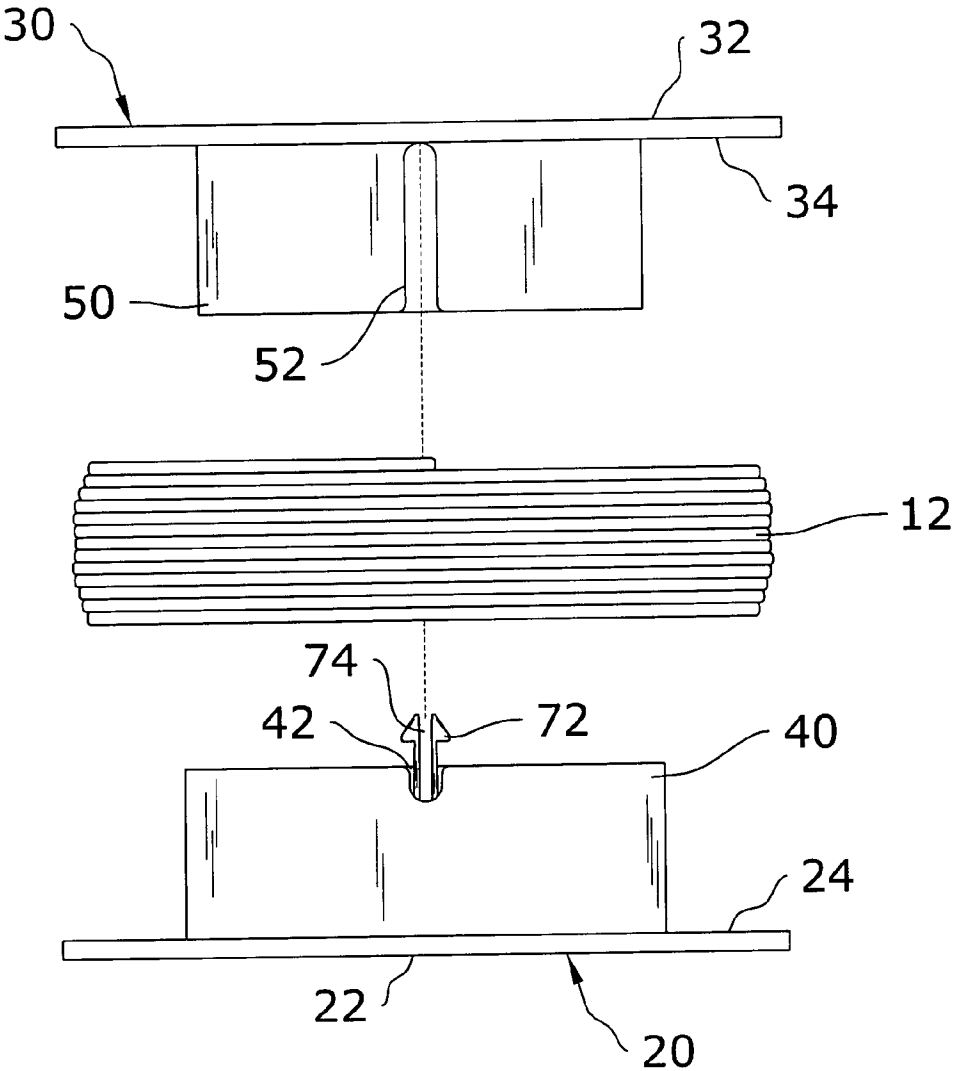
FIG. 5 is an exploded front view of the present invention illustrating the unspooled wire with respect to the wire spooling system components.
Figure 6:
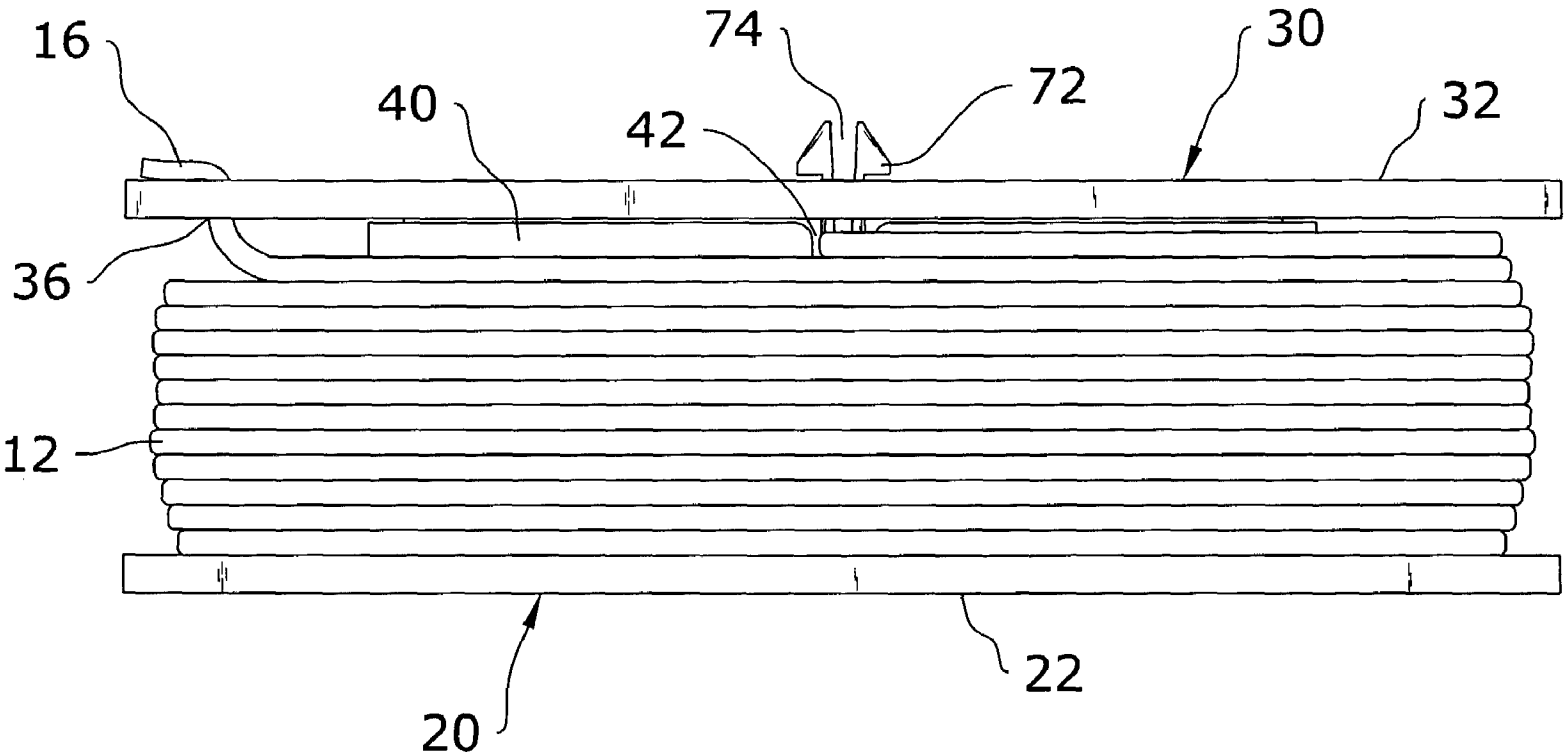
FIG. 6 is a front view of the present invention in an assembled state.

The locking cap 72 has an aperture that is an extension of the hollow channel 74 positioned at the end furthest from the second side 24 of the first spool member 20 as shown in FIGS. 1 through 8. The locking cap 72 is an expanded preferably mushroom-shaped end portion of the tubular member 70 that is used to secure the first spool member 20 and the second spool member 30 together as shown in FIGS. 4 and 8. The locking cap 72 must be small enough to fit through the engagement aperture 76, but large enough to frictionally secure the first spool member 20 to the second spool member 30 via the tubular member 70 as shown in FIGS. 4, 6 and 8.

F. First Collar

The first collar 40 is positioned on the second side 24 of the first spool member 20 as shown in FIGS. 1 through 3. The first collar 40 is preferably circular shaped and protrudes substantially transverse to the second side 24 of the first spool member 20. A notch 42 is carved out of the first collar 40 on the edge opposite the second side 24 of the first spool member 20 as shown in FIGS. 1 through 3 and 5. The first collar 40 is of sufficient size that the second collar 50 may fit within it as shown in FIG. 8.

G. Second Collar

The second collar 50 is positioned on the second side 34 of the second spool member 30 as shown in FIGS. 1 and 5. The second collar 50 is preferably circle shaped and protrudes substantially transverse to the second side 34 of the second spool member 30 as shown in FIGS. 1 and 2. A recess 52 is defined in the second collar 50 as extending across the entire width of the second collar 50 from a first side of the second collar 50 in a plane transverse to that of the first side 22 of said second spool member 30 as shown in FIG. 1. The second collar 50 is preferably capable of fitting within the first collar 40. When aligning the guide members 60 of the first collar 40 with the corresponding guide sleeves 62 of the second collar 50, the second collar 50 fits within the confines of the first collar 40 as shown in FIG. 8. Additionally, upon alignment the notch 42 aligns with a portion of the recess 52 as shown in FIG. 6

H. Engagement Aperture

The engagement aperture 76 preferably passes through the first side 32 and second side 34 of the second spool member 30 as shown in FIGS. 1 through 4 and 7. The engagement aperture 76 is large enough to allow the locking cap 72 and end of the tubular member 70 to pass through, but small enough to frictionally retain the locking cap 72 after the locking cap 72 is inserted through the engagement aperture 76 as shown in FIGS. 4 and 8.

I. Operation of Invention

In use, a user places an unspooled roll of wire 12 over the first collar 40 of the first spool member 20. The user may crimp one portion of the wire 12 that can be inserted into the notch 42 positioned on the first collar 40. Placing the crimped portion of the wire 12 within the notch 42 allows for the recess 52 of the second collar 50 to secure the roll of wire 12 in place following assembly of the wire spooling system 10. The secured wire 14 is retained between the notch 42 and the recess 52, thereby disallowing the roll of wire 12 to rotate about the first collar 40 independent of the rotation of the assembled wire spooling system 10.

Upon placement of the wire 12 on the first collar 40, the user then preferably aligns the guide members 60 with their corresponding guide sleeves 62, and the tubular member 70 with the engagement aperture 76 as shown in FIG. 7. When the guide members 60 and guide sleeves 62 are mated, forcing the first spool member 20 and the second spool member 30 towards each other forces the locking cap 72 to pass through the engagement aperture 76 as shown in FIGS. 4, 6 and 8. The first spooling member 20 and the second spooling member 30 then retain the wire 12 between their respective second sides 24, 34 as shown in FIGS. 4 and 6. The wire spooling system 10 is then assembled as shown in FIGS. 4 and 6. The wire spooling system 10 is then fully assembled as shown in FIGS. 4 and 6.

To efficiently unspool an amount of wire 12, a user may place the hollow channel 74 over a nail or other appendage to facilitate a smooth removal of wire 12 that was not previously on a spool. The user then pulls on the unsecured end of the wire 12, thereby causing the spool to rotate and the wire 12 to be dispensed accordingly. When the wire spooling system 10 is not in use, the user may place the loose end of the wire 12 through the wire-retaining aperture 36 and crimp the wire 12, thereby securing the unused, loose portion of wire 12 shown as secured wire 16 in FIGS. 4 and 6.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A wire spooling system, comprising:

a first spool member;

a tubular member, wherein said tubular member protrudes transversely from said first spool member;

a locking cap positioned at an end of said tubular member opposite of said first spool member;

a first collar protruding from said first spool member;

a second spool member;

a second collar protruding substantially transversely from said second spool member, wherein said second collar fits within said first collar;

an engagement aperture within said second spool member; and wherein said engagement aperture receives said locking cap of said tubular member, thereby securing said first spool member and said second spool member in a substantially spool-shaped locked position.

2. The wire spooling system of claim 1, wherein said first spool member has a first side and a second side that are substantially coplanar.

3. The wire spooling system of claim 1, wherein said first collar is capable of retaining an unspooled amount of wire around its exterior.

4. The wire spooling system of claim 1, wherein said first collar and said second collar are substantially the same shape.

5. The wire spooling system of claim 1, wherein said first collar and said tubular member protrude transverse to said second side.

6. The wire spooling system of claim 1, wherein said first collar has a notch through an edge of said first collar opposite of a side of said first collar that is positioned on said first spool member.

7. The wire spooling system of claim 1, wherein said first spool member has a plurality of guide members protruding transverse to said second side.

8. The wire spooling system of claim 1, wherein said second spool member has a first side and a second side that are substantially coplanar.

9. The wire spooling system of claim 1, wherein said second spool member has a plurality of guide sleeves protruding substantially transverse to said second side of said second spool member.

10. The wire spooling system of claim 9, wherein said second collar has a recess that extends substantially across the entire width of said second collar in a plane transverse to said of said second spool member.

11. The wire spooling system of claim 9, wherein each of said plurality of guide members fits within a corresponding one of said plurality of guide sleeves.

12. The wire spooling system of claim 11, wherein upon alignment and insertion of said plurality of guide members within said plurality of guide sleeves, said notch on said first collar is substantially aligned with said recess on said second collar.

13. The wire spooling system of claim 12, wherein a predetermined portion of said wire is secured between said notch and said recess to prevent a roll of wire positioned radially about said first collar from rotating independent of the wire spooling system.

14. The wire spooling system of claim 13, wherein upon insertion of said plurality of guide members into each corresponding said plurality of guide sleeves, subsequently forcing said first spool member toward said second spool member causes said engagement aperture to receive said locking cap, thereby securing said first spool member to said second spool member.

15. The wire spooling system of claim 14, wherein upon securing said first spool member to said second spool member, the wire positioned radially about the exterior of said first collar is retained on said first collar between said second side of said first spool member and said second side of said second spool member.

16. The wire spooling system of claim 1, wherein said second spooling member has a wire-retaining aperture positioned through said second spool member.

17. The wire spooling system of claim 16, wherein the loose end of the wire may be secured within said wire-retaining aperture between the first side and second side of said second spooling member.

18. The wire spooling system of claim 17, wherein upon securing said first spooling member and said second spooling member together, a hollow channel extends across said tubular member.

19. The wire spooling system of claim 18, wherein said hollow channel extends through said first spool member, through said tubular member, through said engagement aperture on said second spool member, and out a hollow portion on an end of said locking cap.

20. A wire spooling system, comprising:

a first spool member having a first side and a second side that are substantially coplanar;

a tubular member wherein said tubular member protrudes transversely from said second side of said first spool member;

a locking cap positioned at an end of said tubular member opposite of said first spool member;

a first collar protruding from said first spool member substantially transverse to said second side and capable of retaining an unspooled amount of wire around its exterior;

a notch through an edge of said first collar opposite of a side of said first collar positioned adjacent said first spool member;

a plurality of guide members protruding from said first spool member transverse to said second side;

a second spool member having a first side and a second side that are substantially coplanar;

a second collar protruding substantially transversely from said second spool member;

wherein said first collar and said second collar have substantially the same shape;

wherein said second collar fits within said first collar;

a plurality of guide sleeves protruding substantially transverse to said second side of said second spool member;

wherein each of said plurality of guide member fits within a corresponding one of said plurality of guide sleeves;

a recess that extends substantially across the entire width of said second collar in a plane transverse to that of said second spool member;

wherein upon alignment and insertion of said plurality of guide members within said plurality of guide sleeves, said notch on said first collar is substantially aligned with said recess on said second collar;

wherein a predetermined portion of said wire is secured between said notch and said recess to prevent a roll of wire positioned radially about said first collar from rotating independent of said wire spooling system;

an engagement aperture;

wherein said engagement aperture receives said locking cap;

wherein upon insertion of each of said plurality of guide members into each of said plurality of corresponding guide sleeves, subsequently forcing said first spool member toward said second spool member causes said engagement aperture to receive said locking cap, thereby securing said first spool member to said second spool member;

wherein upon securing said first spool member to said second spool member, the wire positioned radially about the exterior of said first collar is retained on said first collar between said second side of said first spool member and said second side of said second spool member;

a wire-retaining aperture positioned through said second spool member;

wherein upon nonuse of said wire spooling system, a free end of wire may be secured within said wire-retaining aperture;

a hollow channel extending through said tubular member through said wire spooling system; and wherein said hollow channel is placed on an appendage to facilitate efficient rotation of said wire spooling system.

* * * * *